United States Patent [19]

Rijnders

[11] 3,987,598

[45] Oct. 26, 1976

[54] PANEL SYSTEM CONSTRUCTION AND PANELS THEREFOR

[75] Inventor: Willem Rijnders, Alblasserdam, Netherlands

[73] Assignee: Hunter Douglas International N.V., Curacao, Netherlands Antilles

[22] Filed: Mar. 14, 1975

[21] Appl. No.: 558,271

Related U.S. Application Data

[62] Division of Ser. No. 363,967, May 25, 1973, Pat. No. 3,906,697.

[30] Foreign Application Priority Data

May 29, 1972 Netherlands ..... 7207264

[52] U.S. Cl. ..... 52/584; 52/145; 52/619

[51] Int. Cl.[2] ..... E04C 1/10

[58] Field of Search ..... 52/619, 584, 145, 144, 52/39, 285

[56] References Cited

UNITED STATES PATENTS

| | | | |
|---|---|---|---|
| 1,965,601 | 7/1934 | Kotrbaty | 52/586 X |
| 2,137,767 | 11/1938 | Betcone | 52/584 X |
| 2,808,624 | 10/1957 | Sullivan | 52/584 X |
| 3,095,943 | 7/1963 | Kemp | 52/145 X |
| 3,626,652 | 12/1971 | Hanley | 52/584 |
| 3,696,571 | 10/1972 | Schluter | 52/144 |

*Primary Examiner*—Price C. Faw, Jr.
*Assistant Examiner*—Carl D. Friedman
*Attorney, Agent, or Firm*—Pennie & Edmonds

[57] ABSTRACT

A panel system is disclosed including panels to provide decorative or acoustic functions or both. The panels comprise essentially hollow elements having two oppositely disposed facing sheets and an internal connecting member joining the two facing sheets. The panels may be secured edge to edge along their longitudinal edges to provide a plurality of adjacent panels. The facing sheets may be perforated and the interior provided with suitable sound absorbing material. The panels may be supported from the ceiling, wall or other fixed structure in a grid-like pattern.

11 Claims, 15 Drawing Figures

FIG. 8
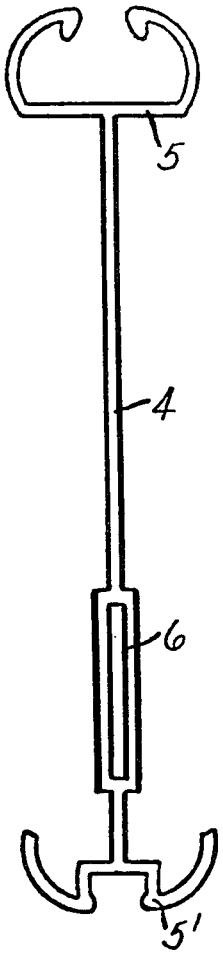
FIG. 9
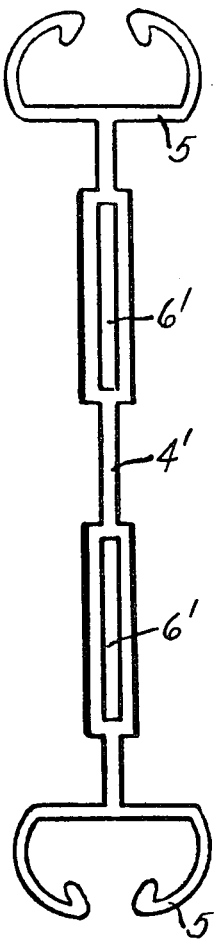
FIG. 10
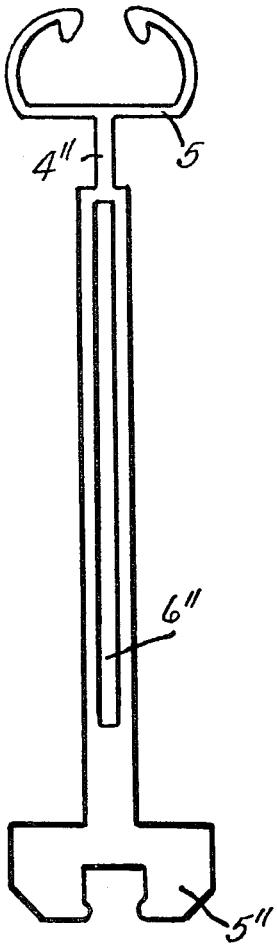
FIG. 11
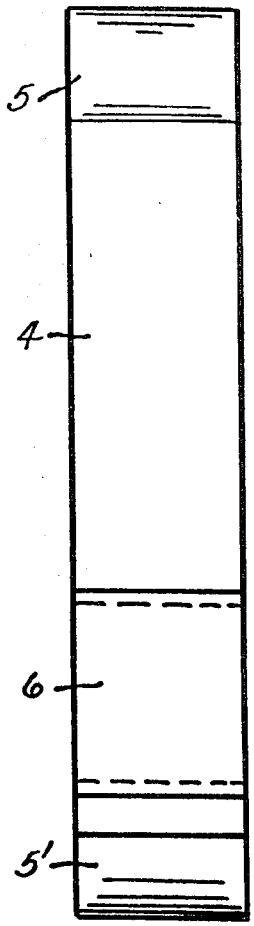
FIG. 12
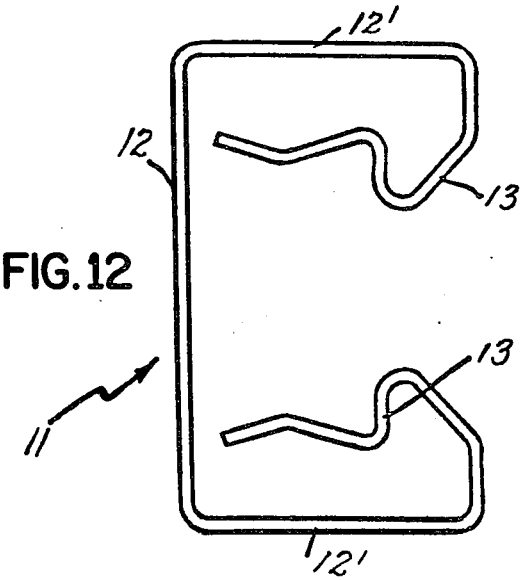
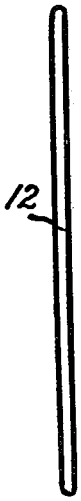
FIG. 13

PANEL SYSTEM CONSTRUCTION AND PANELS THEREFOR

This is a division, of application serial no. 363,967, filed May 25, 1973 now U.S. Pat No. 3,906,697.

One object of the invention is to provide decorative or acoustic ceiling panels which may be supported from a ceiling, overhead beams or a wall.

Another object of the invention is to provide ceiling panels which are hollow and which may be assembled with a minimum of tools.

Another object of the invention is to provide ceiling panels which may be readily interconnected one to the other to provide a plurality of panels for decorative or acoustic purposes in which the connecting member is essentially hidden.

These and other objects will be apparent to those skilled in the art from the following specification and drawings in which;

FIGS. 8, 9 and 10 show various modifications of the connecting member;

FIG. 11 is a side view of FIG. 8;

FIG. 12 shows a side view of a wire spring member for interlocking two adjacent panels;

FIG. 13 is a view from the left of the member of FIG. 12;

Figure 4:
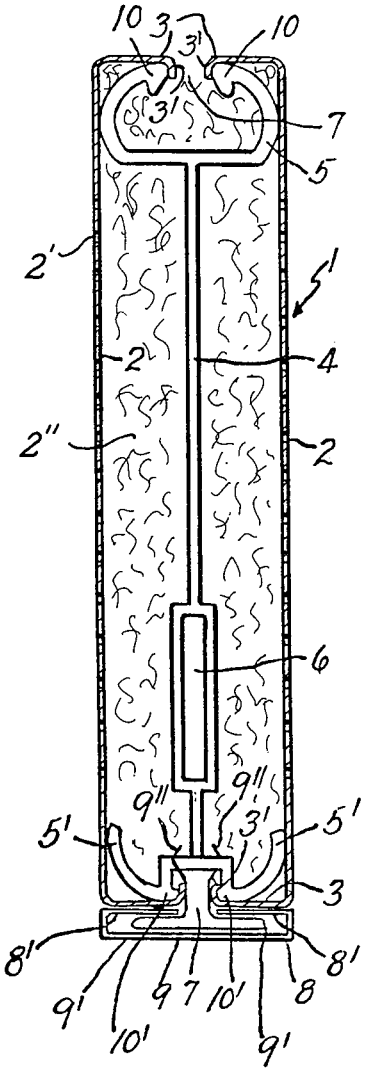
FIG. 4 is an end view of the panel of the invention.
Figure 5:
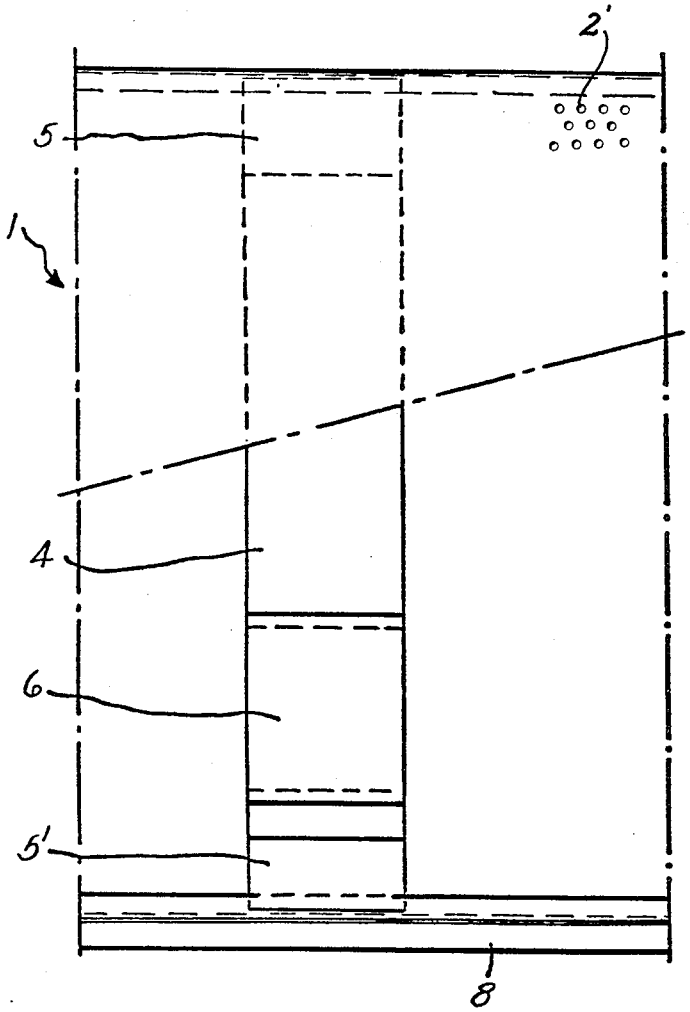
FIG. 5 is a side view of FIG. 4 with a portion of the facing sheet removed.

Referring first of all to FIGS. 4 and 5, generally indicated by the numeral 1 the hollow panels of this invention comprise two identical facing sheets 2 and an intermediate connecting member 4 for holding the facing sheets 2 in a relatively fixed spaced apart position.

The opposite edges of the facing sheets 2 have flanges 3 terminating in inturned lips 3' which resiliently grip the ends 10 and 10' of the arms 5 and 5' respectively on the opposite ends of the connecting member 4. The central web portion of the connecting member 4 has an opening 6, which is described more fully hereinafter.

In the preferred embodiment, the intermediate member 4 is an extruded material of metal, plastic or the like with extruded aluminum being presently preferred. It will be appreciated, however, that other materials such as wood, plastic and other synthetics may be utilized. The facing sheets 2 may be extruded or rolled sheet material of many varieties including metal and is preferably of a resilient or spring-like nature such that the inturned lips 3' may be sprung apart to pass over the points 10 and 10' of the intermediate member 4. The facing sheets 2 are, accordingly, sprung into place and held there by the inherent resiliency of the material.

In the preferred embodiment, the edges of the opposing flanges 3 of the two facing sheets 2 of the panel are spaced apart leaving a longitudinal slot 7 along each of the longitudinal edges of the panel.

Along the lower exposed longitudinal edge of the panel 1 is provided a cover strip or cap 8 held in place by the spring clip 9 having lateral projections 9' to support the inwardly directed flanges 8' of the strip 8. Spaced, upwardly directed legs 9'' are sprung into place in the slot 7 to hold the strip 8 in place.

Figure 6:
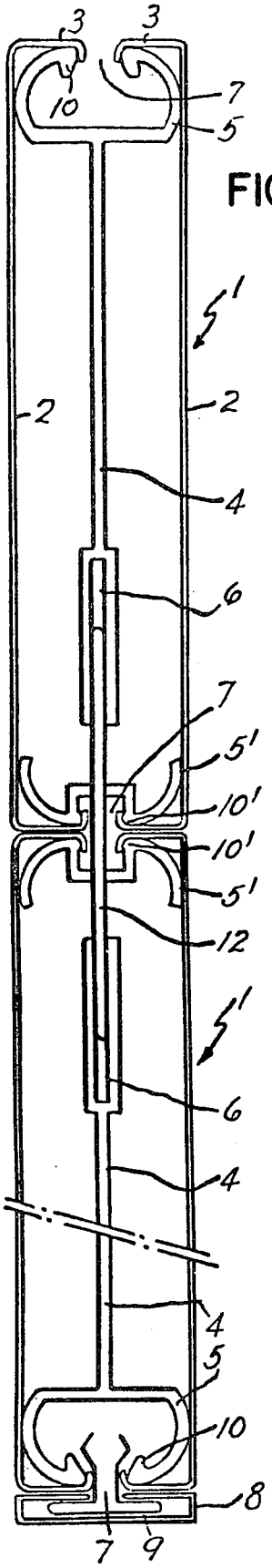
FIG. 6 is an end view of two panels joined together along their adjacent longitudinal edges.
Figure 7:
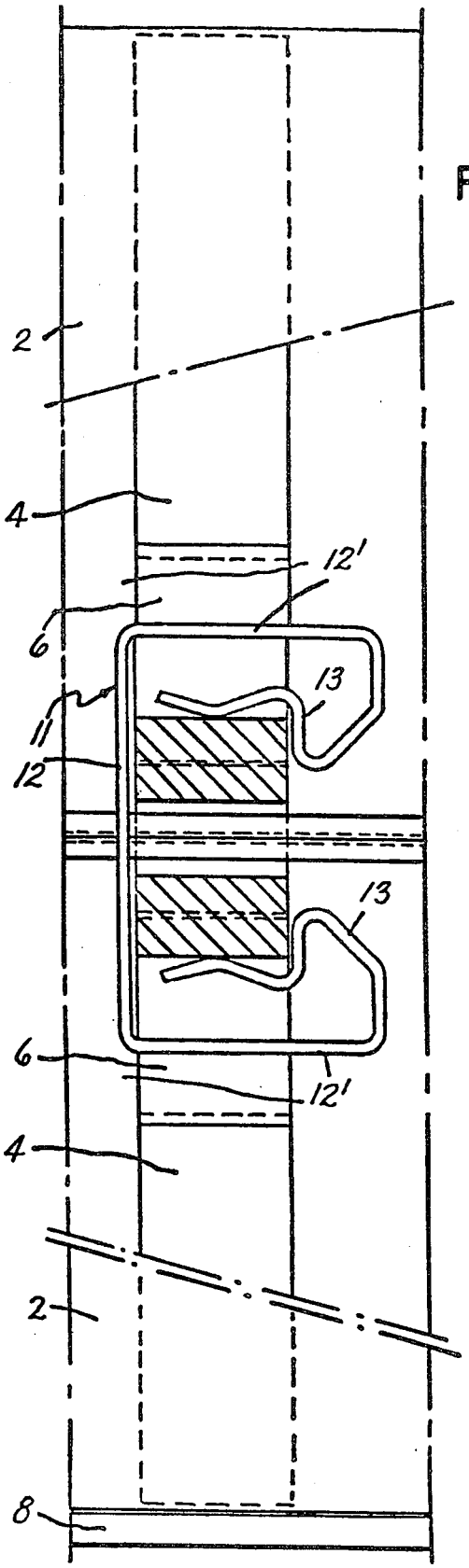
FIG. 7 is a side view of FIG. 6 partially in cross-section.

As shown in FIGS. 6 and 7, two panels 1, may be secured edge-to-edge along their longitudinal edges by means of spring clip 11. Spring clip 11 is generally U-shaped and has two substantially parallel legs 12' each of which includes a gripping portion 13, which engages the member 4 on the side opposite to the bight 12 of the U-shaped member 11. The legs 12' with their gripping portions 13 pass through the openings 6 in connecting members 4 of two adjacent panels 1.

It will be appreciated that while only one connecting member 4 is shown in FIGS. 4 – 7, there are at least two of such interconnecting members one adjacent each end of the panel 1. Intermedidate connecting members 4 may be utilized as desired or required to lend additional rigidity to the panel.

Figure 1:
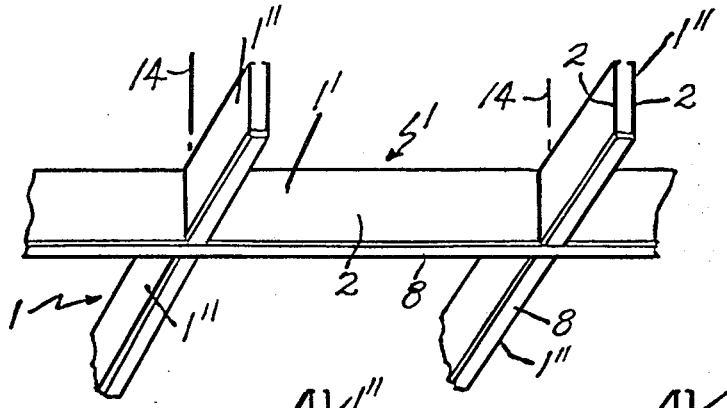
FIGS. 1, 2 and 3 show three different assemblies of the hollow panels of this invention in perspective looking upwardly from beneath the suspended grid of panels.

With reference to FIG. 1, there is shown a grid-like arrangement for supporting the panels from an overhead ceiling structure including beams, overhead fixed floor-ceiling combinations and the like. The panels are supported from such overhead structure by means of members 14 in a manner described in more detail hereinafter. As shown in FIG. 1, the panel 1' extending from left to right in the figure is abutted by the ends of a plurality of panels 1''.

Figure 2:
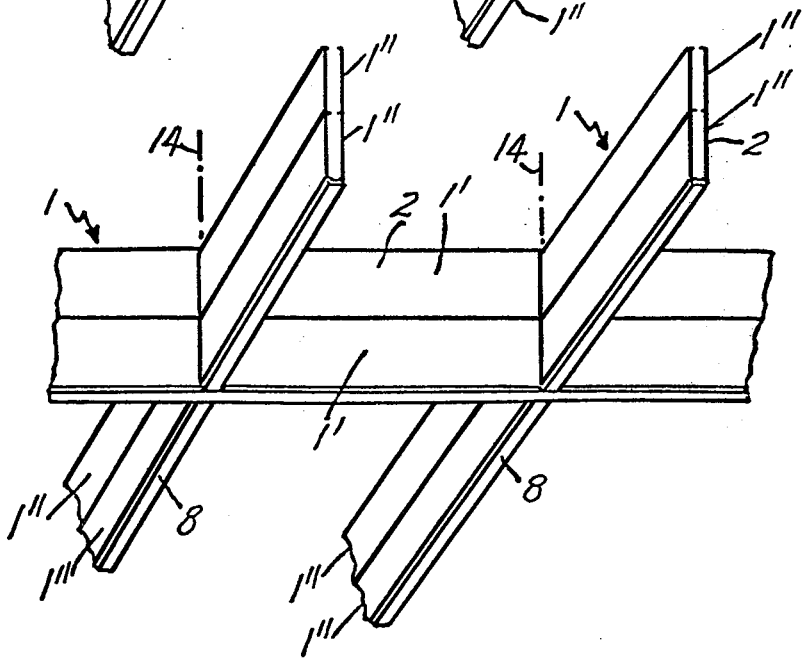

FIG. 2 shows a grid system of panels like that in FIG. 1 excepting only that there are two sets of panels 1' joined together along their longitudinal edges as shown in FIGS. 6 & 7 and two sets of panels 1'' arranged vertically with respect to each other in the same manner. It will be appreciated that while only two such vertically aligned series of panels is shown in FIG. 2 there may be three or more such panels arranged in edge-to-edge relationship along their longitudinal edges.

Figure 3:
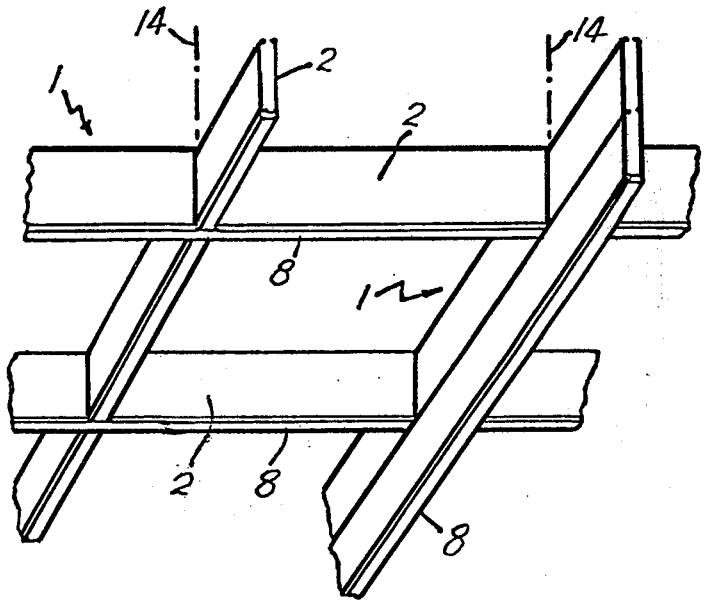

FIG. 3 shows an arrangement in which there is a combination of single panels and a series of double panels thus combining FIGS. 1 and 2.

Figure 14:
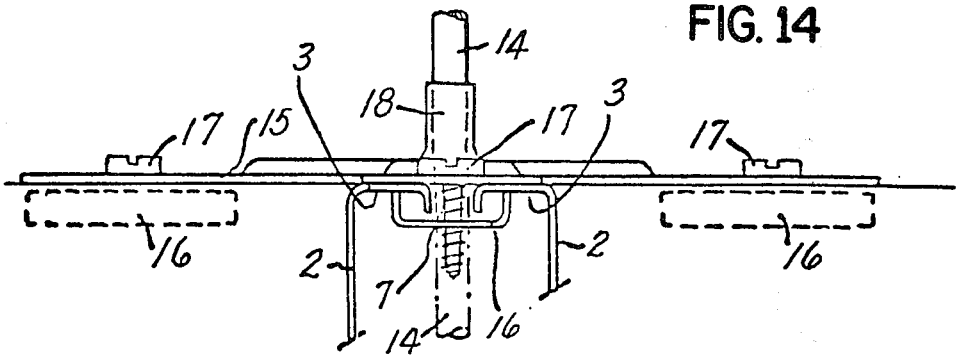
FIG. 14 shows a side view of a means for joining a plurality of panels perpendicular to each other at their point of intersection.
Figure 15:
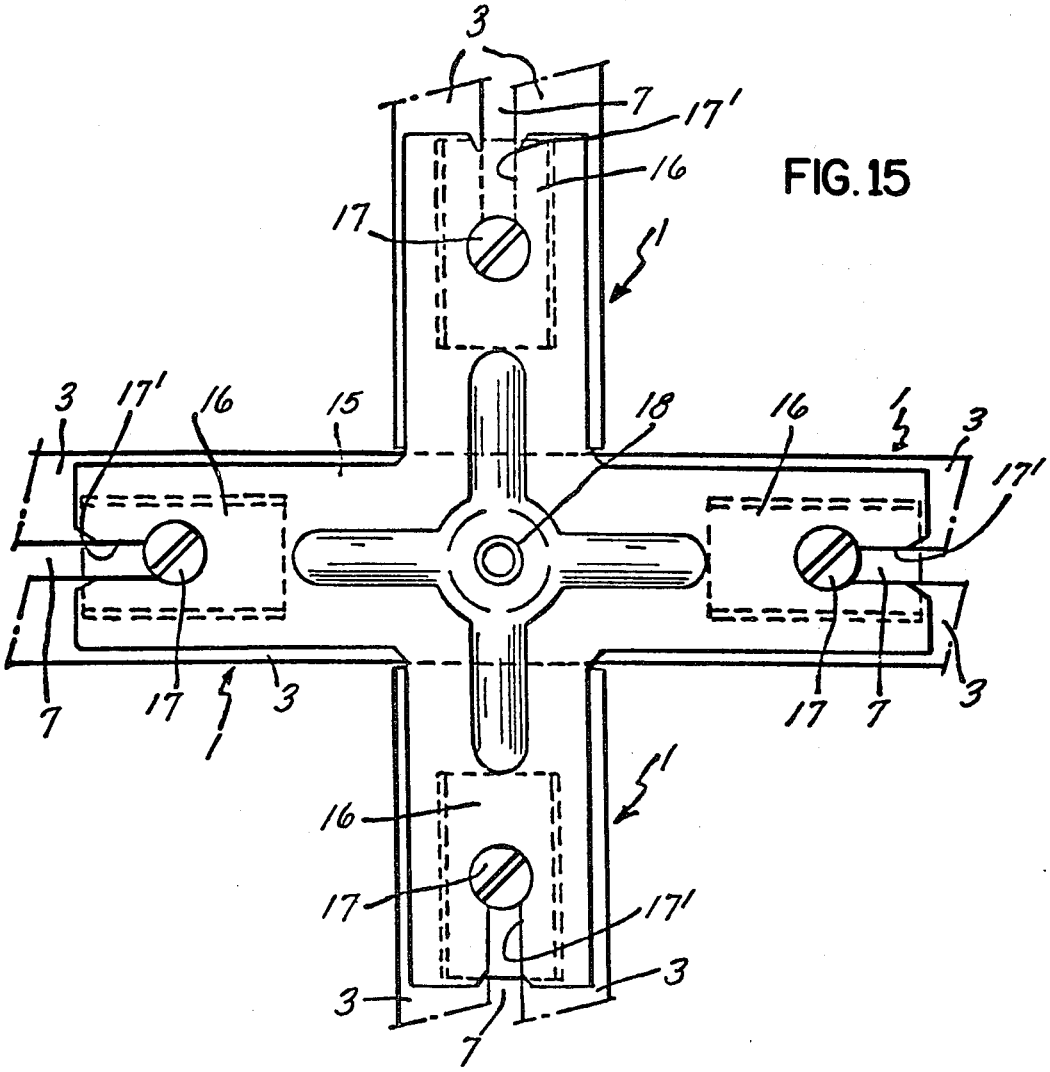
FIG. 15 is a top view of the structure of FIG. 14.

The panels 1 are suspended from the ceiling by means of a rod 14 (See FIGS. 14 & 15), threaded into a hub 18 extending upwardly from a cross-shaped member 15. The member 15 is secured at the intersection of panels 1 by means of screws 17 passing through slots 17' in the ends of the arms of the member 15 and through the slots 7 in the panels 1. A clamping member 16 is positioned within the hollow panels 1 to engage the underside of flanges 3 of the facing sheets 2. The screws 17 threadly engage and draw the clamping member 16 tight against flanges 3. It will be appreciated that while the panels are secured by means of threaded rods 14 other means may be used including, wire, cable and the like designed to engage the member 15 or to pass through the hub 18 into the interior of the panels 1 to be fixed appropriately there.

With respect to slot 7, this slot may be so designed, if desired, as to be closed when the panel is assembled. However, in such circumstances other means must be provided to hold the cover strip 8 such as spaced openings and for accepting the screws 17.

FIGS. 8 and 11 show the intermediate connecting member 4 also shown in use in FIGS. 4 – 7. It will be appreciated that the opening 6 is located adjacent one end of the intermediate member 4, and as such, care must be taken during assembly of two adjacent panels in order to be certain that the openings 6 of the members 4 of the two adjacent panels are toward each other as shown in FIGS. 6 and 7. To overcome this requirement two openings 6' are provided in the intermediate connecting member 4' shown in FIG. 9. In this manner by use of the intermediate connecting member 4', either edge of a completed panel will mate with either edge of an adjacent panel 1, there being an opening 6' on both ends of the intermediate member 4'. Similarly, in FIG. 10 a single long slot 6'' is provided in the intermediate member 4'' thus accomplishing the same purpose as the dual openings 6' in the member 4'.

As shown in FIG. 8, the upper and lower arms 5 and 5' are somewhat differently shaped, either shape being satisfactory. Alternatively, the upper and lower arms may be shaped the same as in FIG. 9 or may have a still different shape as shown at 5'' at the bottom in FIG. 10.

The facing sheets 2 may be perforated 2' in known manner for decorative effects or to permit sound energy to pass through or both. For maximum acoustical absorption, the interior of the panels 1 may be filled with any of a number acoustically absorptive material 2'' well known to the art including various fibers both natural and synthetic.

It will be appreciated that assembly of the panels can be accomplished without any particular use of tools. The facing sheet 2 for one side may be placed on the floor or bench with its flanges 3 upstanding. The connecting member 4 may then be snapped into place with the end portions 10 and 10' engaging between the lips 3' of the upstanding flanges 3. The other facing member 2 may then be snapped in place thereover with its flanges 3 extending downwardly toward the companion flanges 3 of the first facing sheet 2. Thus, both facing sheets 2 are sprung into place due to the spring-like or resilient nature of the material selected for their manufacture. It will be appreciated that the length of the member 4 including its terminal portion 10 and 10' is dimensioned to achieve proper frictional engagement with the spring-like flanges 3 of the facing sheets 2.

If desired, panels 1 may be joined in abutting end-to-end relationship by means of a connecting member 4 of suitable width inserted partly in one of such two adjacent panels and partly in the other.

I claim:

1. A panel system construction comprising at least two panels, each of said panels having two facing sheets and at least two parallel elongated connecting members for holding said sheets in spaced substantially parallel planes on opposite sides of said connecting member; an opening through each of said connecting members, said panels being arranged in substantially the same plane with one edge of each of said panels abutting an edge of the other; said panels being arranged in said plane in such manner that the longitudinal axes of elongated connecting members of one panel are in substantially longitudinal alignment with the longitudinal axes of elongated connecting members of another of said panels; means engaged in the opening of a connecting member of one of said panels and also in the opening of a longitudinally aligned connecting member of an adjacent panel to hold said panels together in edge-to-edge relationship; and said means being disposed entirely between said substantially parallel planes of said facing sheets whereby said means is hidden from view in the completed system.

2. The panel system of claim 1 in which said panels have slots in the abutting edges thereof, said means comprises a spring clip extending through facing slots in the edges of abutting panels and said clips being engaged in said openings of longitudinally aligned connecting members.

3. The panel system of claim 2 in which said spring clip is of substantially U shape having a terminal gripping portion on the ends of the arms of said U, the bight of said U extending through said facing slots to one side of said connecting members, the arms of said U extending through said openings in connecting members, and said gripping portions engaging the side of said connecting members opposite to said one side thereof.

4. A panel system construction comprising a first series of panels, a second series of panels extending at an angle to and intersecting said frist series of panels, each of said panels having two facing sheets and an elongated connecting member for holding said sheets in substantially parallel planes on opposite sides of said connecting member, the upper longitudinal edges of said facing sheets on each panel being inturned toward each other to provide spaced inturned flanges, connecting means for connecting a panel in said first series to a panel in said second series at an intersection thereof, said connecting means including a first element engaged beneath the oppositely inturned flanges of a panel in said first series and a second element engaged beneath the oppositely inturned flanges of a panel in said second series, said connecting means also including portions overlying said inturned flanges above said first and said second elements and clamping said inturned flanges between said elements and said overlying portions.

5. The panel system of claim 4 in which supporting means is provided attached to said connecting means for supporting said series of panels from a fixed structure.

6. The panel system construction of claim 4 in which the ends of panels of one of said series abutt the sides of panels of the other of said series.

7. The panel system construction of claim 6 in which the major plane of said panels is vertical.

8. The panel system construction of claim 4 in which said panels are acoustical.

9. The panel of claim 8 in which said facing sheets have perforations therethrough whereby sound energy may pass through said facing sheets.

10. The panel of claim 9 in which the interior of said panel contains acoustically absorptive material.

11. A panel system construction comprising a first series of panels, a second series of panels extending at an angle to and intersecting said first series of panels, the ends of panels of one of said series abutting the sides of panels of the other of said series, each of said panels having two facing sheets and an elongated connecting member for holding said sheets in substantially parallel planes on opposite sides of said connecting member, connecting means secured to a panel in said first series and to a panel in said second series at an intersection thereof, means for supporting said series of panels from a fixed structure including means attached to said connecting means, an opening through each of said connecting members, at least two of said panels in at least one of said series being arranged in substantially the same vertical plane with one edge of each thereof abutting an edge of the other thereof, said at least two panels being arranged in said vertical plane in such manner that the longitudinal axes of elongated connecting members of one panel are in substantially longitudinal alignment with the longitudinal axes of elongated connecting members of the other of said at least two panels, a slot in the abutting edges of said at least two panels, means extending through said slots and engaged in an opening of a connecting member of one of said at least two panels and also engated in the opening of a connecting member of the other of said at least two panels to hold said panels together in edge-to-edge relationship in substantially the same vertical plane; and said means extending through said slots being disposed entirely between said substantially parallel planes of said facing sheets whereby said means extending through said slots is hidden from view in the completed system.

* * * * *